United States Patent [19]

Salis

[11] Patent Number: 4,606,776

[45] Date of Patent: Aug. 19, 1986

[54] AIR BRUSH CLEANING UNIT

[75] Inventor: Lawrence R. Salis, Ft. Lauderdale, Fla.

[73] Assignee: Salis International, Inc., Hollywood, Fla.

[21] Appl. No.: 655,589

[22] Filed: Sep. 28, 1984

[51] Int. Cl.[4] ..... B08B 3/00; B08B 3/02

[52] U.S. Cl. ..... 134/36; 15/38; 15/302; 55/242; 239/113

[58] Field of Search ..... 134/6, 34, 36, 37, 17, 134/10, 22.12, 38; 15/38, 302; 55/242, 259; 239/112, 113

[56] References Cited

U.S. PATENT DOCUMENTS

| | | | |
|---|---|---|---|
| 2,848,340 | 8/1958 | Haldas | 106/90 |
| 3,014,530 | 12/1961 | Harvey et al. | 166/293 |
| 3,346,487 | 10/1967 | Irani et al. | 252/8.5 C |
| 3,346,488 | 10/1967 | Lyons et al. | 252/8.5 C |
| 3,354,495 | 11/1967 | Lawrence, III | 15/302 |
| 3,376,114 | 4/1975 | Hicks et al. | 239/112 |
| 3,409,080 | 11/1968 | Harrison | 166/293 |
| 3,491,049 | 1/1970 | Gibson et al. | 524/8 |
| 3,511,314 | 5/1970 | Scott et al. | 166/293 |
| 3,654,151 | 4/1972 | King et al. | 252/8.5 C |
| 3,657,134 | 4/1972 | King et al. | 252/8.5 C |
| 3,658,563 | 4/1972 | Washio et al. | 501/94 |
| 3,689,296 | 9/1972 | Landry | 106/90 |
| 3,769,051 | 10/1973 | Hardin | 106/90 |
| 3,892,709 | 7/1975 | Oda et al. | 523/210 |
| 3,940,063 | 2/1976 | Baumgartner et al. | 239/112 |
| 3,941,772 | 3/1976 | Ploger et al. | 546/6 |
| 4,040,854 | 8/1977 | Persinski et al. | 106/87 |
| 4,125,160 | 11/1978 | Crinkelmeyer et al. | 166/293 |
| 4,210,455 | 7/1980 | Metcalf et al. | 106/90 |
| 4,260,422 | 4/1981 | Thamm et al. | 106/111 |
| 4,403,364 | 9/1983 | Schroeder | 15/38 |
| 4,413,681 | 11/1983 | McKenzie | 166/291 |
| 4,460,126 | 7/1984 | Gates et al. | 239/112 |
| 4,466,835 | 8/1984 | Crump et al. | 106/90 |
| 4,466,836 | 8/1984 | Crump et al. | 106/90 |
| 4,468,252 | 8/1984 | Crump et al. | 106/90 |

*Primary Examiner*—Andrew H. Metz
*Assistant Examiner*—Sharon T. Cohen
*Attorney, Agent, or Firm*—Howard C. Miskin

[57] ABSTRACT

A device for minimizing ambient pollution attendant to the cleaning of an airbrush includes a small box having a centrally located front opening for seating the air brush spray tip and a rear exhaust opening. The top wall is movable to an open position to permit replacement of rectangular filters which are releasably retained in longitudinally spaced positions by channels located on the box interior side faces, the filters being hydrophobic and of successively finer porosity and delineating between them successive diffusion and particulate matter precipitating chambers. The airbrush tip is seated in the inlet opening and actuated with a cleaning fluid which removes particulate residue from the airbrush and deposits it on the walls of successive chambers and on the filters.

5 Claims, 4 Drawing Figures

AIR BRUSH CLEANING UNIT

BACKGROUND OF THE INVENTION

The present invention relates generally to the field of antipollution and it relates particularly to an improved method and apparatus for minimizing the pollution to the ambient atmosphere attendant to the cleaning of airbrushes.

Airbrushes, including spray guns and similar tools are widely used in many applications, for example, by photographers and artists for applying shading and color to drawings, prints, and photographs to accentuate highlights and for other purposes. Airbrushes utilize compressed air to break up or atomize a pigment carrying liquid which is drawn into a thin stream and directed as a fine spray from a needle valve controlled spray nozzle or tip. The pigmented liquid traversed passageways and components of the airbrush require frequent cleaning to prevent and remove any pigment and binder which may deposit on these components, and this is commonly achieved by spraying depending on the ink or paint vehicle employed a cleaning liquid such as water, an aqueous cleaning solution or an organic solvent. This cleaning procedure is generally performed with the changing of the colors being used or before any appreciable interruption in the use of the air brush, particularly before an extended dormant period. The cleaning spray is generally released into the ambient atmosphere thereby polluting the atmosphere with particulate pigment and in many cases with other contaminants which may be carciogenic and toxic and in any case highly undesirable and frequently hazardous.

SUMMARY OF THE INVENTION

It is a principal object of the present invention to provide an improved anti-pollution method and apparatus.

Another object of the present invention is to provide an improved method and apparatus for minimizing the pollution of the ambient atmosphere attendant to the cleaning of an airbrush by the spraying of a cleaning solution therethrough.

A further object of the present invention is to provide a method and apparatus of the above nature characterized by their convenience, reliability, high efficiency and effectiveness, ease of application, low cost and great versatility and adaptability.

The above and other objects of the present invention will become apparent from a reading of the following description taken in conjunction with the accompanying drawings which illustrate a preferred embodiment thereof.

The method and apparatus of the present invention is employed with conventional air brushes including spray guns and the like in which a liquid vehicle carrying a pigment or other coloring substance in fine particulate form is controllably sprayed as a confined high velocity mist of low divergence, the air brush being cleaned between different color applications by substituting a cleaning fluid for the sprayed ink or paint to remove any deposits or remnants of particulate material in the airbrush reservoir, passageways and nozzle. In accordance with the present improved method the cleaning fluid mist spray is directed from the nozzle into a substantially closed small precipitating or condensing chamber communicating with the ambient atmosphere through a porous first filter, the spray being diffused and expanded in the chamber with the particulate material entrained in the mist, alone or with the liquid, depositing on the faces of the chamber with the residual liquid evaporating. Advantageously, the cleaning fluid spray is directed at and enters the chamber through a porous second filter which separates some of the particulate material and promotes the diffusion of the spray mist into the chamber.

An apparatus in accordance with the present invention includes a chamber having a front inlet opening shaped and dimensioned to engage or seat the tip portion of the airbrush and a rear relatively large exhaust opening and a porous filter disposed between the inlet and exhaust openings Advantageously, a plurality of replaceable filters is provided which are longitudinally spaced along and extend transversely across the chamber between the openings and which with the walls of the chamber delineate successive compartments, the filters preferably being successively finer from the chamber front to the rear. A lid or door provides access to the chamber interior to facilitate replacement and cleaning of the filters.

With the present improved method and apparatus an air brush can be reliably and efficiently cleaned in the conventional manner even in small confined areas with a minimum or no significant pollution of the ambient atmosphere the method and apparatus are simple easy, inexpensive and of great versatility and adaptability.

DESCRIPTION OF THE PREFERRED EMBODIMENT

Figure 1:
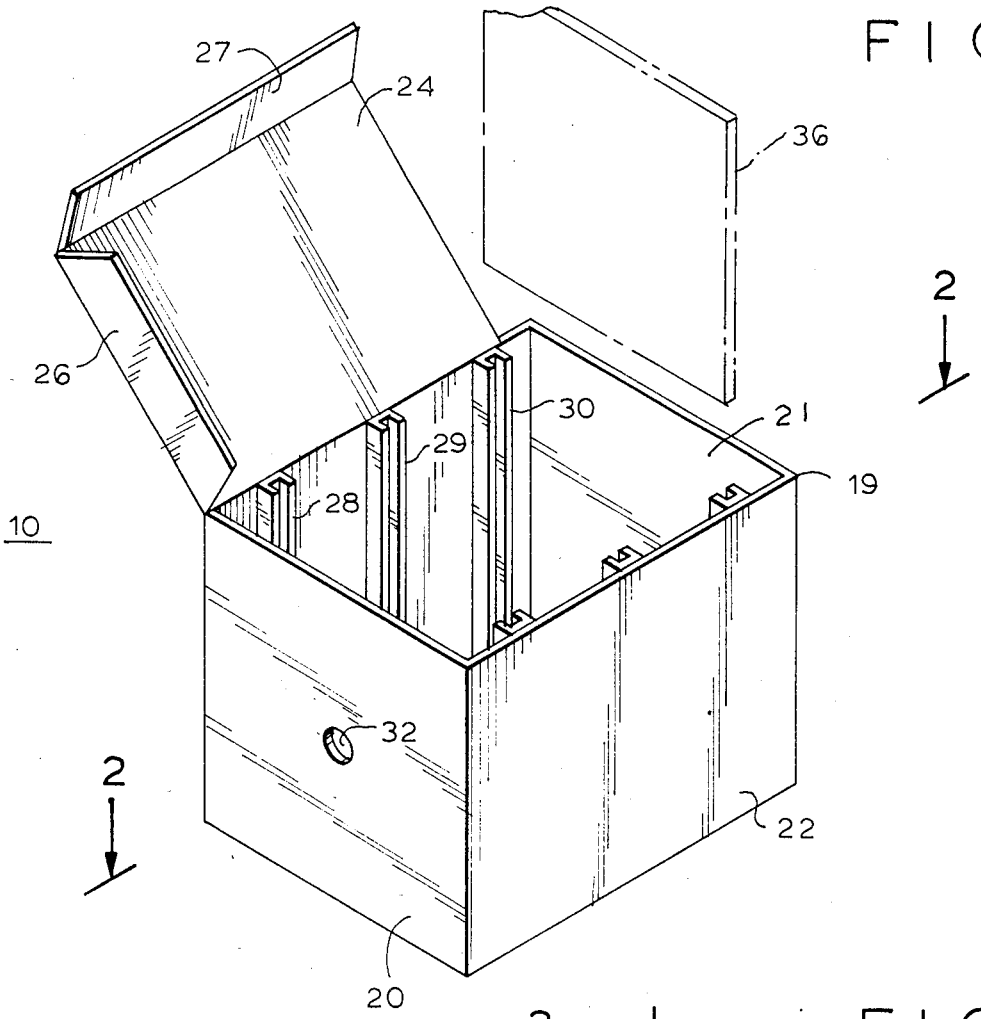
FIG. 1 is a perspective view of a preferred embodiment of an antipollution device in accordance with the present invention, shown in open condition with the absence of the filter members.

Referring now to the drawings which illustrate a preferred embodiment of the present invention, the reference numeral 10 generally designates the improved antipollution device which is shown applied to an airbrush 11. Airbrush 11 may be of any conventional construction and includes a hand held cylindrical body 12 terminating at its front end in a comically shaped spray tip or nozzle having a peripheral ridge 14 between its front and rear. A small cup reservoir 16 is located on body member 12 and axially communicates with nozzle 13 by way of a needle valve which is finger controlled by a button lever 17 which likewise controls the feed of compressed air which is delivered to the airbrush by a flexible hose 18 connected to a pressurized gas source.

Figure 2:
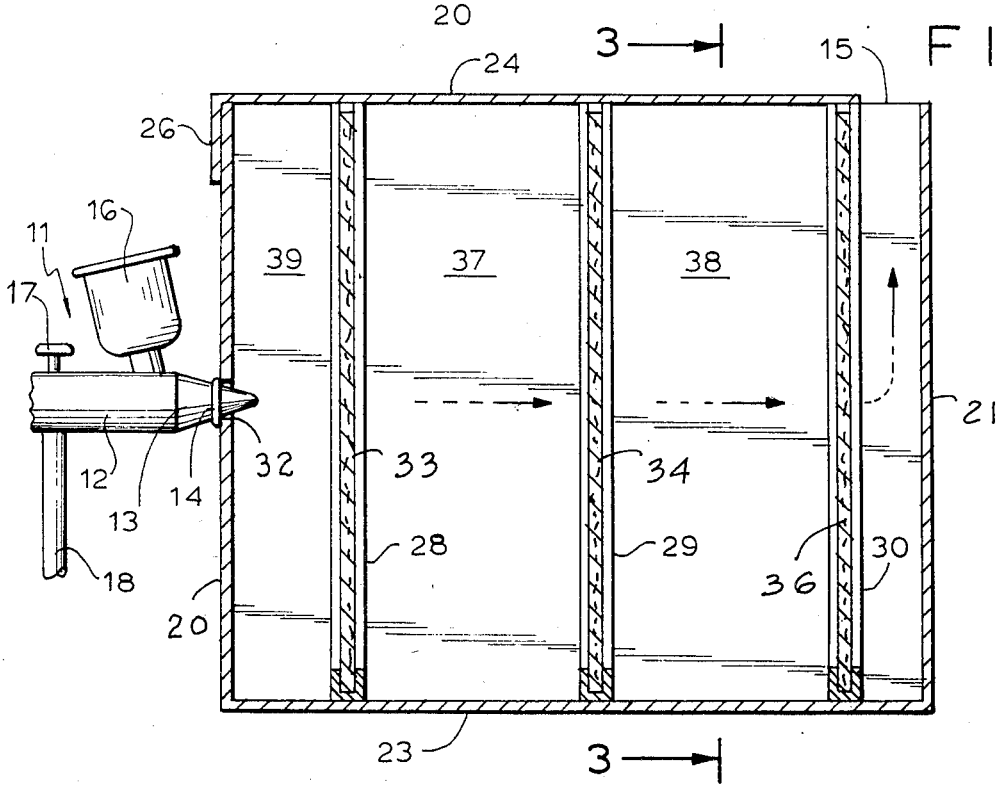
FIG. 2 is a medial longitudinal sectional view thereof taken along lines 2—2 in FIG. 1, with the filter members in place and the device in closed operative condition, an airbrush being shown in cooperative association with the device.
Figure 3:
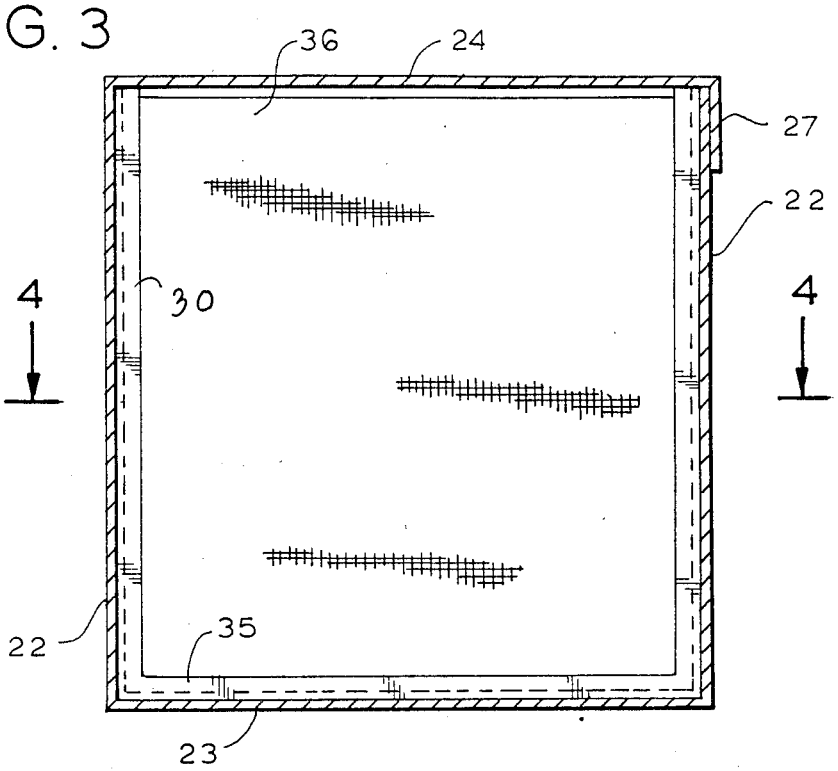
FIG. 3 is a sectional view taken along line 3—3 in FIG. 2.
Figure 4:
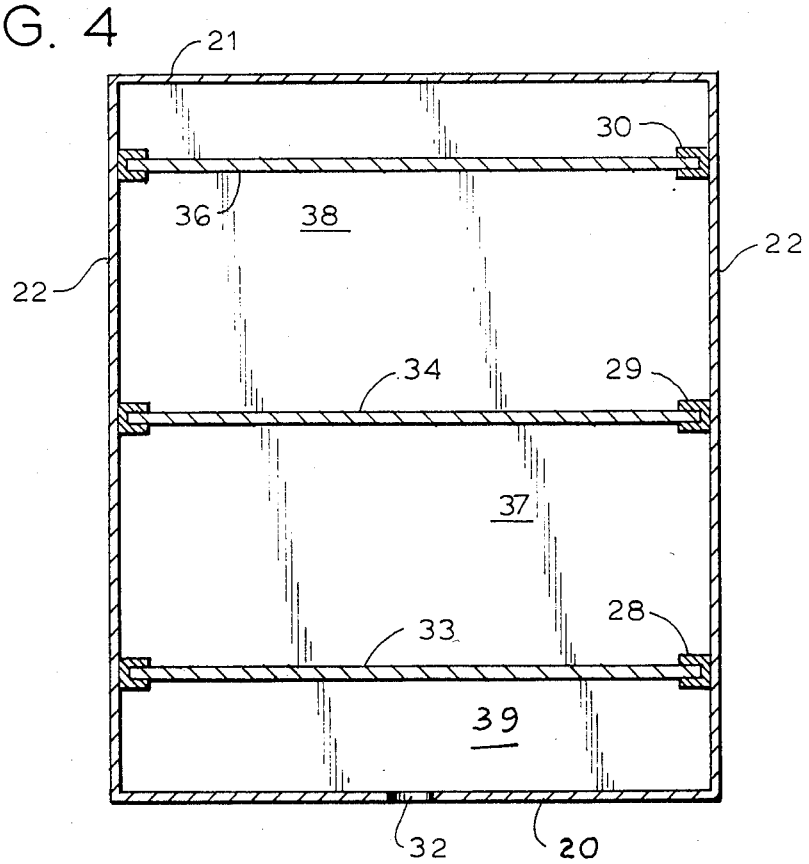
FIG. 4 is a sectional view taken along line 4—4 in FIG. 3.

The antipollution device 10 comprises a chamber defining box 19 which is formed of cardboard, fiberboard, plastic, metal or other suitable material and includes rectangular front and rear walls 20 and 21 respectively, rectangular side walls 22 and a rectangular base wall 23. A rectangular cover 24 is suitably hinged, for example by a live or self hinge, to the upper edge of a side wall 22 and extends from the front wall 20 to a point short of the rear wall 21. When cover 24 is in its closed position overlying and engaging the top opening of box 19 as shown in FIG. 2, the transverse rear edge of cover 24 is spaced forwardly of the top edge of rear wall 21 to delineate therewith a rectangular exhaust opening 15 extending for the width of box 19. Depending from the front and side edges of cover 24 are flaps or flanges 26 and 27 respectively which in the closed condition of cover 24 releasably engage the upper borders of front wall 20 and the side wall 22 opposite the side wall 22 to which cover 24 is hinged. It should be noted that cover 24 need not be hinged to a side wall 22 but may be hinged to the front or rear wall or may be in the form of a flanged lid capping box 19 except for the rear portion.

Suitably affixed to the inside faces of opposite side walls 22 are three pairs of transversely aligned front, intermediate and rear vertical filter retainer channels 28,29 and 30 respectively. Channel pairs 28 and 30 are spaced relatively short distances from front and rear walls 20 and 21 respectively and channel pair 29 is substantially midway between channel pairs 28 and 30 and spaced therefrom relatively long distances. The bottoms of corresponding channels 28, 29 and 30 on each pair thereof are connected by a respective transverse channel 35 on box base wall 23. An inlet opening 30 preferably circular, is centrally formed in front wall 20 and is dimensioned, for example between $\frac{1}{4}$ and $\frac{3}{4}$ inch diameter, to separably receive in substantially close engagement therewith or to seat an airbrush tip 13 or a portion thereof to substantially close or greatly restrict opening 32.

A rectangular first relatively coarse self sustaining filter member equal in height to front and rear walls 20 and 21 has its side borders in vertically slidably separable engagement with opposing front channels 28 and extends from channel 35 on base wall 23 to closed cover 24. A similarly shaped second filter 34 of finer porosity than first filter 33 is vertically releasably supported by and between channels 29 and a still finer porosity filter 36 similar in shape to filters 33 and 34 is vertically releasably supported by and between channels 30. Filters 33, 34 and 36 delineate with the box walls successive relatively large compartments 37 and 38 respectively, front wall 20 and filter 33 delineating a relatively narrow inlet compartment 39 and rear wall 21 and filter 36 delineate a relatively narrow compartment which in the closed position of cover 24 exhausts to the exterior through exhaust opening 15. The filters 33,34 and 36 may be replaced by opening cover 24 as shown in FIG. 1, to provide access to the box interior and permit the upward slidable separation of the filters from the respective channel pairs and their corresponding insertion.

The filters 33,34 and 36 are formed of hydrophobic materials preferably resistant to organic solvents, such as fiberglass, polyurethane, polyester, nylon, polyolefin an the like and may be formed of fibers or filaments or may be of porous reticulated structure.

The antipollution device 10 is applied to the cleaning of airbrush 11 which is performed in the usual manner shortly after a use of the airbrush by first emptying reservoir 16 and filling it with a cleaning fluid whose composition depends on the composition of the ink or paint employed with the airbrush. The cleaning fluid may, for example, be water, water and a dissolved cleaning agent or an organic solvent. The cleaning fluid loaded air brush is held with its spray tip engaging and preferably substantially closing inlet opening 32 and button 17 manipulated to open the air valve and liquid needle valve whereby to produce a spray which is projected to and through first filter 33 which diffuses and passes the diffused particulate material suspending mist into first compartment 37. The mist expands in the first chamber to deposit particulate material or pigment on the faces of the first compartment and the mist carrying residual finer particulate material, travels under pressure through second filter 34 which separates some of the particulate material, some of the remaining particulate material depositing on the faces of second compartment 38. The particulate matter impoverished mist then traverses third filter 36 where additional particulate material is removed and travels through the end compartment and exhaust opening 15 into the ambient atmosphere. Some of the advancing particulate material deposits on filters 33,34 and 36.

Employing a box 19 approximately seven inches long, four inches high and five inches wide and filters 33, 34 and 36 approximately $\frac{1}{4}$ thick and of successively finer porosity from the front to the rear, the device 10 in no way interfered with the normal cleaning of the airbrush and removed over about 90% of the particulate material emerging from the airbrush. The filters may, if necessary, be periodically cleaned in an aqueous detergent or a suitable solvent.

While there have been described and illustrated preferred embodiments of the present invention it is apparent that numerous alterations, omissions and additions may be made without departing from the spirit thereof.

I claim:

1. In the method of cleaning of an airbrush in which a cleaning fluid is fed under pressure through the airbrush to a spray nozzle at the tip of the brush and projected under the influence of said pressure as a spray, the improvement comprising applying the airbrush tip into engagement with an inlet opening in the front of a chamber having a rear exhaust opening while retaining said airbrush substantially externally of said chamber, said chamber having a porous first filter between said openings and a diffusion compartment between the filter and exhaust opening and actuating the airbrush to feed the cleaning fluid through the airbrush to pick up residue along the passage of the fluid through the airbrush to and through the nozzle and project the spray of the residue carrying cleaning fluid produced by the airbrush spray nozzle under the influence of said pressure onto the filter whereby the fluid traverses the filter and diffuses in the leading compartment to deposit residue on the walls of the compartment.

2. The improvement of the method of claim 1 wherein a gas under pressure is fed through the air brush and is admixed with and pressurizes the cleaning fluid and the residue impoverished gas exhausts from said chamber through said exhaust opening.

3. The improvement of the method of claim 2 wherein the plurality of longitudinally spaced transversely extending filters are traversed by the spray and the residue entrained therein is deposited on the walls of compartments delineated between successive filters.

4. The improvement of the method of claim 3 wherein some of said residue is deposited on said filters.

5. The improvement of the method of claim 4 wherein said filters are of successively finer porosity from said inlet opening to said outlet opening.

* * * * *